US005171421A

United States Patent [19]

Forester

[11] Patent Number: 5,171,421

[45] Date of Patent: Dec. 15, 1992

[54] METHOD FOR CONTROLLING FOULING DEPOSIT FORMATION IN A LIQUID HYDROCARBONACEOUS MEDIUM

[75] Inventor: David R. Forester, Conroe, Tex.

[73] Assignee: Betz Laboratories, Inc., Trevose, Pa.

[21] Appl. No.: 756,819

[22] Filed: Sep. 9, 1991

[51] Int. Cl.[5] ..... C10G 9/12; C10G 9/16

[52] U.S. Cl. ..... 208/48 AA; 208/48 R; 208/47; 585/950

[58] Field of Search ..... 208/48 AA; 585/950

[56] References Cited

U.S. PATENT DOCUMENTS

| | | | |
|---|---|---|---|
| 2,993,771 | 6/1961 | Stromberg | 208/48 AA |
| 3,030,387 | 4/1962 | Benoit, Jr. | 208/48 AA |
| 3,172,892 | 3/1965 | Le Suer et al. | 260/326.5 |
| 3,224,957 | 12/1965 | Kent | 208/48 AA |
| 3,235,484 | 2/1966 | Colfer | 208/48 |
| 3,271,295 | 9/1966 | Gonzales | 208/48 AA |
| 3,271,296 | 9/1966 | Gonzales | 208/48 AA |
| 3,412,029 | 11/1968 | Andress, Jr. | 208/48 AA |
| 3,437,583 | 4/1969 | Gonzalez | 208/48 |
| 3,442,791 | 5/1969 | Gonzales | 208/48 AA |
| 3,483,133 | 12/1969 | Hatch | 208/48 AA |
| 3,567,623 | 3/1971 | Hagney | 208/48 AA |
| 3,776,835 | 12/1973 | Dvoracek | 208/48 AA |
| 4,578,178 | 3/1986 | Forester | 208/48 |
| 4,686,054 | 8/1987 | Wisotsky et al. | 252/32.7 |
| 4,775,459 | 10/1988 | Forester | 208/48 |
| 4,883,886 | 11/1989 | Huang | 549/255 |

*Primary Examiner*—Helane Myers

*Attorney, Agent, or Firm*—Alexander D. Ricci; Bruce E. Peacock

[57] ABSTRACT

Polyalkenylsuccinimide-maleic anhydride reaction products are used as effective antifoulants in liquid hydrocarbonaceous mediums, such as crude oils and gas oils, during processing of such liquids at elevated temperatures. The reaction products are formed via a two-step reaction in which a polyalkenylsuccinic anhydride precursor is reacted with an amine to form polyalkenylsuccinimide intermediate which, in turn, is reacted with maleic anhydride.

16 Claims, No Drawings

METHOD FOR CONTROLLING FOULING DEPOSIT FORMATION IN A LIQUID HYDROCARBONACEOUS MEDIUM

FIELD OF THE INVENTION

The present invention pertains to the use of maleic anhydride modified polyalkenylsuccinimides to inhibit fouling in liquid hydrocarbon mediums during the heat treatment processing of the medium, such as in refinery processes.

BACKGROUND OF THE INVENTION

In the processing of petroleum hydrocarbons and feedstocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 40° to 550° C., frequently from 200°-550° C. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, maleic anhydride modified polyalkenylsuccinimides are used to inhibit fouling of heated liquid hydrocarbon mediums. Typically, such antifoulant protection is provided during heat processing of the medium, such as in refinery, purification, or production processes.

The maleic anhydride modified polyalkenylsuccinimides are formed via a two-step reaction. In the first step, a polyalkenylsuccinic anhydride is reacted with an amine, preferably a polyamine, such as a polyethyleneamine, in order to form a polyalkenylsuccinimide intermediate. The intermediate is then reacted with maleic anhydride to form the desired reaction product.

PRIOR ART

Maleic anhydride modified polyalkenylsuccinimides, of the type used herein to control fouling in hot process fluids, are disclosed in U.S. Pat. No. 4,686,054 (Wisotsky et al). In accordance with the '054 disclosure, the disclosed maleic anhydride modified polyalkenylsuccinimides are used as dispersants for both gasoline engine and diesel engine lubricating oil. Efficacy in the '054 disclosure is assessed by the "MS Sequence VD Engine Test" and the "Caterpillar 1-H/2" test so as to evaluate the effects of a candidate crank case oil on ring sticking and piston deposits. In contrast, the present invention calls for inhibition of fouling in liquid hydrocarbonaceous mediums during the high temperature processing of the medium. Studies have indicated that many compounds known to be useful as lubricating oil detergent-dispersants do not adequately function as process antifoulants during heat treatment processing of the treated medium.

Of interest to the use of succinic acid and succinic anhydride derivatives is U.S. Pat. No. 3,235,484 (Colfer et al) which discloses amine reaction products of succinic acid and succinic anhydrides. These materials are used to inhibit carbonaceous material formation in refinery cracking units. U.S. Pat. No. 3,172,892 (LeSuer et al) teaches the use of high molecular weight succinimides as dispersants in lubricating compositions with Gonzalez in U.S. Pat. No. 3,437,583 teaching combinations of metal deactivator, phenolic compound, and substituted succinic acid or anhydride used to inhibit fouling in hydrocarbon process fluids.

One particularly successful group of antifoulants is reported in U.S. Pat. No. 4,578,178 (Forester—of common assignment herewith). This patent discloses the use of polyalkenylthiophosphonic acid esters as antifoulants in heat treated hydrocarbon mediums with the Group II(a) cation salts of such acids being specified in U.S. Pat. No. 4,775,459 (Forester—of common assignment herewith).

DETAILED DESCRIPTION

I have found that maleic anhydride modified polyalkenylsuccinimides provide significant antifoulant efficacy in liquid hydrocarbonaceous mediums during the high temperature treatment of the medium.

It is to be understood that the phrase "liquid hydrocarbonaceous medium" as used herein signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residua, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The maleic anhydride modified polyalkenylsuccinimides useful in the invention are generally prepared via a two-step reaction. In the first step, a polyalkenylsuccinic anhydride is reacted with a polyamine, preferably a polyethyleneamine, to form the desired polyalkenylsuccinimide. Then, the polyalkenylsuccinimide is reacted with maleic anhydride in an organic solvent medium to form the desired reaction product.

More specifically, the starting reactant, polyalkenylsuccinic anhydride may be purchased commercially or prepared. Presently, it is preferred to buy this from Texaco. One such commercially sold polyalkenylsuccinic anhydride is sold under the trademark TLA-627. It is a polyisobutenylsuccinic anhydride (PIBSA) having the structure

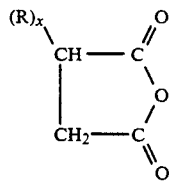

(I)

wherein, in this case, R is an isobutenyl repeat unit. The average molecular weight of the polyisobutene used to produce the PIBSA is about 1300.

The precursor polyalkenylsuccinic anhydride may also be prepared as reported in U.S. Pat. No. 3,235,484 (Colfer), incorporated herein by reference or, more preferably, by the methods reported in U.S. Pat. No. 4,883,886 (Huang) also incorporated by reference herein. As to the Colfer method, the anhydrides may be prepared by reaction of maleic anhydride with a high molecular weight olefin or a chlorinated high molecular weight olefin. In the preferred Huang method, reaction of a polymer of a $C_2$–$C_8$ olefin and maleic anhydride are carried out in the presence of a tar and side product suppressing agent.

The most commonly used sources for forming the aliphatic R substituent on the succinic anhydride compound (I) are the polyolefins, such as polyethylene, polypropylene, polyisobutene, polyamylene, polyisohexylene, etc. The most particularly preferred polyolefin (and the one used to manufacture the polyisobutenylsuccinic anhydride from Texaco) is polyisobutene. As Colfer states, particular preference is made for such a polyisobutene-containing at least about 50 carbon atoms, preferably from at least 60 carbon atoms and most desirably from about 100 to about 130 carbon atoms. Accordingly, an operable carbon atom number range for R is from about 30–200 carbon atoms.

Once the polyalkenylsuccinic anhydride precursor is obtained, it is reacted with a polyamine, as reported in Colfer, at temperature in excess of about 80° C. so as to form an imide. More specifically, the polyalkenylsuccinic anhydride

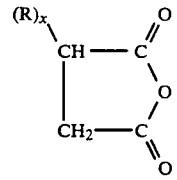

(I)

wherein R is an aliphatic alkenyl or alkyl moiety having at least about 50 carbon atoms and less than about 200 carbon atoms, is reacted with a polyamine having the structure

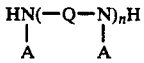

(II)

in which n is an integer, A is chosen from hydrocarbyl, hydroxyalkyl or hydrogen with the proviso that at least one A is hydrogen. Q signifies a divalent aliphatic radical. As Colfer indicates, the A substituents can be considered as forming a divalent alkylene radical, thus resulting in a cyclic structure. Q generally, however, is ($C_1$–$C_5$) alkylene, such as ethylene, trimethylene, tetramethylene, etc. Q is most preferably ethylene.

Accordingly, exemplary amine components may comprise ethylenediamine, triethylenetetramine, tetraethylenepentamine, diethylenetriamine, trimethylenediamine, bis(trimethylene)triamine, tris(trimethylene)tetramine, tris(hexamethylene)tetramine, decamethylenediamine, N-octyltrimethylenediamine, N,N'-dioctyltrimethylenediamine, N-(2-hydroxyethyl)ethylenediamine, piperazine, 1-(2-aminopropyl)piperazine, 1,4-bis(2-aminoethyl)piperazine, 1-(2-hydroxyethyl)piperazine, bis-(hydroxypropyl)substituted tetraethylenepentamine, N-3-(hydroxypropyl)tetramethylenediamine, pyrimidine, 2-methylimidazoline, polymerized ethyleneimine, and 1,3-bis(2-aminoethyl)imidazoline.

The reaction of precursor polyalkenyl succinic anhydride with amine (II) is conducted at temperature in excess of 80° C. with use of a solvent, such as benzene, xylene, toluene, naphtha, mineral oil, n-hexane, etc. Preferably, the reaction is conducted at from 100°–250° C. with a molar amount of precursor anhydride (I): amine (II) being from about 1:5 to about 5:1 with a molar amount of 1–3:1 being preferred.

The polyalkenylsuccinimide so obtained will have the structure

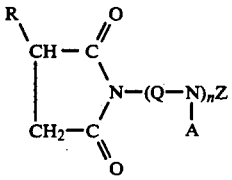

(III)

wherein R, Q, A and n are as previously defined in connection with structural formulae I and II. Z is either H or

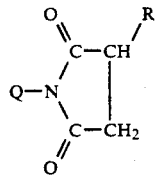

After the polyalkenylsuccinimide precursor has been obtained, it is reacted with maleic anhydride as reported in U.S. Pat. No. 4,686,054 (Wisotsky et al), herein incorporated by reference, to form the desired reaction product. This reaction is generally carried out in an organic solvent medium at about 150°-175° C. under a nitrogen blanket. After filtration of the product, additional solvent may be added so that the reaction product may be administered to the desired hot process fluid, in need of antifoulant protection, in solution form. Conversely, the reaction product can be dispersed in a carrier liquid and fed to the hot process fluid in that form.

As to the amount of maleic anhydride used for reaction with the intermediate polyalkenylsuccinimide, this is based upon the amount of amine used to form the imide intermediate and can vary from equimolar amounts to as much as ten times the molar amount of amine used. Preferably from about 2-5 moles of maleic anhydride is employed per mole of amine.

At present, preliminary studies have indicated surprisingly effective antifouling inhibition results with a maleic anhydride derivative of a polyalkenylsuccinimide intermediate formed from a 2:1 molar ratio of polyisobutenyl succinic anhydride (mw isobutenyl moiety $\approx$ 1300) with triethylenetetramine. This intermediate was then reacted with maleic anhydride in a molar ratio of 2.4 moles maleic anhydride:1 mole amine.

The maleic anhydride derivatives useful in the invention may be added to or dispersed within the liquid hydrocarbonaceous medium in need of antifouling protection in an amount of 0.5-10,000 ppm based upon one million parts of the liquid hydrocarbonaceous medium. Preferably, the antifoulant is added in an amount of from 1 to 2500 ppm.

The maleic anhydride derivatives may be dissolved in a polar or non-polar organic solvent, such as heavy aromatic naphtha, toluene, xylene, or mineral oil and fed to the requisite hot process fluid or they can be fed neat thereto. These derivatives are especially effective when added to the liquid hydrocarbonaceous medium during the heat processing thereof at temperatures of from 100°-550° C.

The following examples are included as being illustrative of the invention and should not be construed as limiting the scope thereof.

EXAMPLES

Preparation—Maleic Anhydride Modified Polyalkenyl Succinimide (PBSM)

A reaction product in accordance with the invention was prepared via a two-step reaction starting with a polyisobutenyl succinic anhydride (PIBSA) precursor. PIBSA, (Mw $\approx$ 1300 polyisobutene moiety) was first reacted with triethylenetetramine in a 2:1 mole ratio. The resulting succinimide was then modified with maleic anhydride according to example 3 of U.S. Pat. No. 4,686,054. A maleic anhydride modified polyisobutenylsuccinimide (PBSM) was formed. The product was diluted to 50% concentration by addition of mineral oil (Mentor 28) thereto.

Efficacy

In order to ascertain the efficacy of the maleic anhydride-polyisobutenylsuccinimide reaction products in inhibiting deposit formation in liquid hydrocarbonaceous mediums during elevated temperature treatment, test materials were subjected to a dual fouling apparatus test. In the dual fouling apparatus, process fluid (crude oil) is pumped from a Parr bomb through a heat exchanger containing an electrically heated rod. Then the process fluid is chilled back to room temperature in a water-cooled condenser before being remixed with the fluid in the bomb.

The Dual Fouling Apparatus (DFA) used to generate the data shown in the following Tables I and II, contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\frac{\text{Avg. } \Delta\text{Area(control)} - \Delta\text{Area(treatment)}}{\text{Avg. } \Delta\text{Area(control)}} \times 100 = \%\ \text{protection}$$

Results are shown in Tables I and II.

TABLE I

| Additive | Desalted Crude Oil A 482° C. Rod Temperature (Active ppm) | % Protection |
|---|---|---|
| PIBSI | 62.5 | 8 (avg.) |
| | 250 | 18 |
| PBSM | 62.5 | 30 |
| | 250 | 44 |

PIBSI = polyisobutenylsuccinimide mw isobutenyl moiety $\approx$ 1300, available Lubrizol
PBSM = maleic anhydride - polyisobutenylsuccinimide reaction product made in accord with the preparation example supra.

Additional tests with the dual fouling apparatus were undertaken to confirm the test results reported in Table I supra., these test results are reported in Table II.

TABLE II

| Crude Oil | Additive | Desalted Crude Oil PPM Active | Rod Temperature °C. | % Protection |
|---|---|---|---|---|
| B | PIBSI | 62.5 | 454 | 17 |
| | PBSM | 62.5 | 454 | 62 |
| B | PIBSI | 250 | 454 | 17 |
| | PBSM | 250 | 454 | 38 |
| C | PIBSI | 250 | 413 | 42 |
| | PBSM | 250 | 413 | 75 |
| C | PIBSI | 250 | 441 | 50 |
| | PBSM | 250 | 441 | 21 |
| D | PIBSI | 250 | 316 | 9 |
| | PBSM | 250 | 316 | 31 |
| D | PIBSI | 500 | 316 | 33, 97 (65 avg.) |

TABLE II-continued

| Crude Oil | Additive | Desalted Crude Oil PPM Active | Rod Temperature °C. | % Protection |
|---|---|---|---|---|
| | PSBM | 500 | 316 | 30 |

PIBSI and PBSE are the same as in Table I.

Another series of tests adapted to assess candidate efficacy in providing fouling inhibition during high temperature treatment of liquid hydrocarbon mediums were performed. These tests are titled the "Hot Filament Fouling Tests" and were run in conjunction with gas oil hydrocarbon mediums. The procedure for these tests involves the following:

Hot Filament Fouling Tests (HFFT)—A preweighed 24-gauge Ni-chrome wire is placed between two brass electrodes in a glass reaction jar and held in place by two brass screws. 200 mls of feedstock are measured and added into each sample jar. One sample jar is left untreated as a control with other jars being supplied with 31 to 125 ppm (active) of the candidate material. The brass electrode assembly and lids are placed on each jar and tightly secured. The treatments are mixed via swirling the feedstock. Four sample jars are connected in series with a controller provided for each series of jars.

The controllers are turned on and provide 8 amps of current to each jar. This amperage provides a temperature of about 125°-150° C. within each sample jar. After 24 hours of current flow, the controllers are turned off and the jars are disconnected from their series connection. The wires, which have been immersed in the hot medium during the testing, are carefully removed from their jars, are washed with xylene and acetone, and are allowed to dry.

Each wire and the resulting deposits thereon are weighed with the weight of the deposit being calculated. Photographs of the wires are taken comparing untreated, treated, and clean wires from each series of experiments using a given controller.

The deposit weight for a given wire was calculated in accordance with $$\text{wt. deposit} = \left(\begin{matrix}\text{weight of wire}\\ \text{plus deposit}\end{matrix}\right) - (\text{original wire weight})$$

The percentage protection for each treatment sample was then calculated as follows:

$$\%\ \text{protection} = \left[1 - \frac{\text{wt. deposit(treated)}}{\text{wt. deposit(untreated)}}\right] \times 100$$

Results are shown in Table III.

TABLE III

| Additive | ppm Actives | Feedstock Type | % Protection |
|---|---|---|---|
| PIBSI | 31 | SRLGO | 78 |
| PBSM | 31 | SRLGO | 87 |
| PIBSI | 31 | CCLGO | 33 |
| PBSM | 31 | CCLGO | 85 |
| PIBSI | 500 | SRLGO | 40 avg. |
| PIBSI | 500 | CCLGO | 89 avg. |

TABLE III-continued

| Additive | ppm Actives | Feedstock Type | % Protection |
|---|---|---|---|
| PBSM | 500 | CCLGO | 90 |

In Table III, SRLGO means straight run light gas oil from a midwestern refinery with CCLGO indicating a catalytic cracked light gas oil from the same midwestern refinery.

PIBSI and PBSE are the same as per Table I.

Discussion

As can be seen by the above efficacy examples, the maleic anhydride-polyisobutenyl succinimide reaction products (PBSM) are generally more effective in inhibiting fouling of the tested heated liquid hydrocarbonaceous medium than the commercially available polyisobutenylsuccinimide.

In accordance with the patent statutes, the best mode of practicing the invention has been set forth. However, it will be apparent to those skilled in the art that many other modifications can be made without departing from the invention herein disclosed and described.

I claim:

1. A method of inhibiting fouling deposit formation in a liquid hydrocarbonaceous medium during heat processing of said medium at elevated temperatures of from about 200° C.-550° C., wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium, an antifouling amount of a reaction product of a polyalkenylsuccinimide having the formula

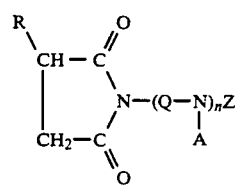

wherein R is an aliphatic alkenyl or alkyl moiety having at least about 50 carbon atoms and less than about 200 carbon atoms, Q is a divalent aliphatic radical, n is a positive integer, A is hydrocarbyl, hydroxyalkyl or hydrogen, Z is H or

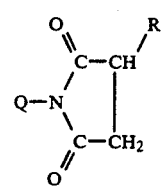

with maleic anhydride.

2. A method as recited in claim 1 further comprising adding from about 0.5-10,000 parts by weight of said reaction product to said liquid hydrocarbonaceous medium based upon one million parts of said hydrocarbonaceous medium.

3. A method as recited in claim 1 wherein said liquid hydrocarbonaceous medium comprises crude oil, straight run gas oil, or catalytically cracked light gas oil.

4. A method as recited in claim 1 wherein R comprises more than 50 carbon atoms and is a polyalkenyl moiety.

5. A method as recited in claim 4 wherein R comprises a repeated isobutenyl moiety.

6. A method as recited in claim 5 wherein Q is chosen from $C_1$–$C_5$ alkylene and A is hydrogen.

7. A method as recited in claim 6 wherein Q is ethylene.

8. A method as recited in claim 4 wherein R has a molecular weight of about 1300.

9. A method for inhibiting fouling deposit formation in a liquid hydrocarbonaceous medium during heat processing of said medium at elevated temperatures of from about 200° C.–550° C., wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium, an antifouling amount of an antifoulant reaction product, said antifoulant reaction product formed by first reaction of polyalkenylsuccinic anhydride with polyamine to form a polyalkenylsuccinimide intermediate, followed by a second stage reaction of said intermediate with maleic anhydride to form said antifoulant reaction product.

10. A method as recited in claim 9 wherein said polyamine comprises an ethylenepolyamine.

11. A method as recited in claim 10 wherein said ethylenepolyamine comprises triethylenetetramine.

12. A method as recited in claim 10 wherein in said first reaction said polyalkenylsuccinic anhydride is present in a molar amount of from about 0.2–5 moles based upon 1 mole of said ethylenepolyamine.

13. A method as recited in claim 10 wherein in said first reaction said polyalkenylsuccinic anhydride is present in a molar amount of from about 1–3 moles based upon 1 mole of said ethylenepolyamine.

14. A method as recited in claim 12 wherein in said second stage reaction said maleic anhydride is added to said intermediate in an amount of 1–10 moles of said maleic anhydride per mole of ethylenepolyamine present in said first reaction.

15. A method as recited in claim 14 comprising adding said antifoulant reaction product to said liquid hydrocarbonaceous medium in an amount of 0.5–10,000 parts by weight of said antifoulant reaction product based upon one million parts of said liquid hydrocarbonaceous medium.

16. A method as recited in claim 15 wherein said liquid hydrocarbonaceous medium comprises crude oil, straight run gas oil or catalytically cracked light gas oil and wherein said polyalkenylsuccinic anhydride comprises polyisobutenylsuccinic anhydride wherein the molecular weight of the isobutenyl moiety is about 1300.

* * * * *

UNITED STATES PATENT AND TRADEMARK OFFICE

CERTIFICATE OF CORRECTION

PATENT NO. : 5,171,421

DATED : Dec. 15, 1992

INVENTOR(S) : David R. Forester

It is certified that error appears in the above-identified patent and that said Letters Patent is hereby corrected as shown below:

In Column 5, line 1 and Column 8, line 52, please delete the formula

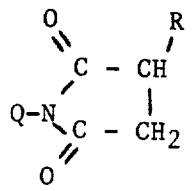

and substitute therefor the following:

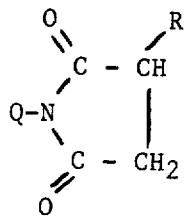

In Column 7, line 7 and Column 8, line 8, please delete "PBSE" and substitute therefor ---PBSM---.

Signed and Sealed this

Nineteenth Day of July, 1994

*Attest:*

*Attesting Officer*

Bruce Lehman

BRUCE LEHMAN

*Commissioner of Patents and Trademarks*